United States Patent [19]

Stockmann et al.

[11] 3,944,146

[45] Mar. 16, 1976

[54] CRUSHER GAP SETTING BY ULTRASONIC MEASUREMENT

[75] Inventors: Helmut Stockmann, Wesseling; Willy Jakobs, Porz-Grengel, both of Germany

[73] Assignee: Klockner-Humboldt-Deutz Aktiengesellschaft, Germany

[22] Filed: Nov. 15, 1974

[21] Appl. No.: 524,126

[30] Foreign Application Priority Data

Nov. 17, 1973 Germany ..... 2357432

[52] U.S. Cl. ..... 241/30; 241/37; 241/208

[51] Int. Cl.[2] ..... B02C 2/04

[58] Field of Search ..... 241/30, 33, 37, 208; 73/67.8

[56] References Cited

UNITED STATES PATENTS

| | | | |
|---|---|---|---|
| 2,280,226 | 4/1942 | Firestone | 73/67.8 |
| 2,941,732 | 6/1960 | Cross et al. | 241/37 X |
| 3,133,706 | 5/1964 | Mertz | 241/37 X |
| 3,303,694 | 2/1967 | D'Onofrio | 73/67.8 X |
| 3,532,277 | 10/1970 | Decker et al. | 241/208 |

*Primary Examiner*—Granville Y. Custer, Jr.
*Attorney, Agent, or Firm*—Hill, Gross, Simpson, Van Santen, Steadman, Chiara & Simpson

[57] ABSTRACT

A method for determining the adjustment of a crusher gap setting and/or crusher rate of wear in a gyratory crusher with hydraulic adjustment of the crusher cone height. The invention allows measurement of the gap while the machine is in motion and this data permits automatic adjustment during operation.

19 Claims, 2 Drawing Figures

CRUSHER GAP SETTING BY ULTRASONIC MEASUREMENT

BACKGROUND OF THE INVENTION

1. Field of the Invention

The present invention relates generally to gyratory rock crushers and more particularly to a method of measuring a crusher gap conveniently when a crushing cone is in operation.

2. Description of the Prior Art

With the increasing size of crusher installations, particularly crusher installations which are connected in series for continuous operation such as with a blast furnace, the desire exists for convenient and reliable remote control of the crusher gap and associated discharge setting.

As disclosed in German Auslegeschrift No. 2,230,788 it is known how to adjust a crusher gap by measuring the position of a crusher cone with reference to the housing by use of inductive or capacitive transmitting. However, since a stationary crushing sleeve fixed on the housing and a lining on the cone wear with time, accurate adjustment of the gap is only possible by a continuous analysis of crushed product grain size. The height of the crushing cone with respect to the housing does not reflect the wearing of the sleeve and lining.

With the existing methods of gap measurement described above, automatic adjustment is not possible since the grain size must be manually analyzed.

An additional disadvantage of the capacitance or inductance method is the inherent inaccuracy of the measurements.

SUMMARY OF THE INVENTION

It is an object of the present invention to accurately and conveniently measure the crusher gap of a gyratory crusher.

It is a further object of the present invention to measure the crusher gap while the crusher cone is in gyratory operation.

It is another object of the present invention to automatically readjust the crusher gap as a result of changes in a continuous data feed showing a change of the crusher gap due to wearing or other operating parameters.

It is a further object of this invention to measure the thickness of the crusher sleeve to determine wear.

The invention is utilized in conjunction with a gyratory rock crusher having a housing member with a crusher sleeve attached thereto. A crusher cone with a lining thereon gyrates in a horizontal plane within the crusher sleeve. The crusher cone is mounted on a supporting shaft whose height is hydraulically adjustable. As the cone is raised, the gap between the sleeve and cone is narrowed.

Ultrasonics are used to measure the thickness of the crusher sleeve and the relative height of the crushing cone with reference to the housing. One ultrasonic transducer head is mounted on the outside surface of the crusher sleeve and another on the cylinder floor of the hydraulic lifting chamber controlling the elevation of the crusher cone. A transmitted signal is reflected at each transmission medium discontinuity. In the invention, these discontinuities are the inner surface of the crusher sleeve and a reflector plate mounted to the upper adjusting piston end of the hydraulic chamber.

The reflections or echoes are received and the times of transmission constants of the transporting mediums provide a direct measurement of distance. By comparing the changes in thickness of the crusher sleeve to the changes of height for the crusher cone, the crusher gap changes can be directly computed. Since no measurements are made with respect to the horizontally gyrating crusher cone other than height, there is no need to stop the machine. An additional benefit of the impulse-echo technique is the inherent measurement accuracy of ultrasonics. Also, since these accurate measurements provide continuous data, the height of the crusher cone and thereby the crusher gap may be automatically controlled by feeding a correction signal to the hydraulic control system.

If a strong ultrasonic signal is transmitted by the head mounted on the exterior of the crusher sleeve, a reflection not only occurs at the inner surface of the sleeve, but also an echo can be detected from the adjacent crushing cone lining surface. Hence, the time difference between the transmitted signal and inner surface reflection provides a direct measure of the crusher surface thickness and the time between the inner surface reflection and lining reflection is a measurement of the crusher gap. It should be noted, however, that the differing transmission constants of the crusher sleeve and air in the crusher gap must be taken into account. Also, this direct measurement method requires a stationary crusher head which is aligned at closest approach to the crusher sleeve.

The temperature of the hydraulic liquid in the adjustable cylinder chamber is measured by a temperature scanner. A signal from this device is used to correct the distance signal provided by the ultrasonic head mounted on the cylinder floor since hydraulic liquid temperature changes affect the sound transmission characteristics.

The time signals generated by ultrasonics and the temperature signal described above is fed into a computer. There, the crusher gap is computed after taking into consideration the distance and angle relationships of the crusher together with the transmission characteristics of the materials through which the ultrasonic waves travel. This computer drives a digital display indicating gap width or crusher sleeve thickness. An oscilloscope calibrated in distances may be used to display the ultrasonic transmissions and echoes after correction for transmission medium constants. This provides a visual picture of the sleeve thickness and crusher gap width.

In the preferred embodiment, the computer described above is connected to the hydraulic control system to automatically change the crusher gap in response to surface wear. However, since the lining of the crusher cone also wears and changes the crusher gap, thickness valves based upon experience must be periodically fed to the computer. Actual thickness values cannot be determined by the ultrasonic method described above since the transfer of the measuring signals by cable is not possible due to the rotation of the crushing cone.

In an installation where several crushers are employed, a computer may be used as a central command post for maintaining control over all the crushers simultaneously by analyzing the ultrasonic pulses from each crusher.

Each of the ultrasonic transducer heads is located in a cavity directly adjacent the transmission medium which is the subject of measurement. Such a location has the advantage of eliminating any reflective surfaces between the transducer and the medium to be measured. Hence, measurement accuracy is increased and interference eliminated. Also, a low power ultrasonic signal may be used.

Since ultrasonic transmissions and reflections through the liquid in the hydraulic cylinder are attenuated by the dissipating nature of the fluid, the separate reflector surface is mounted to the bottom of the adjusting piston with a large space between the two. This shortens the transmission path and allows the use of weaker ultrasonic signals.

DESCRIPTION OF THE PREFERRED EMBODIMENTS

Figure 1:
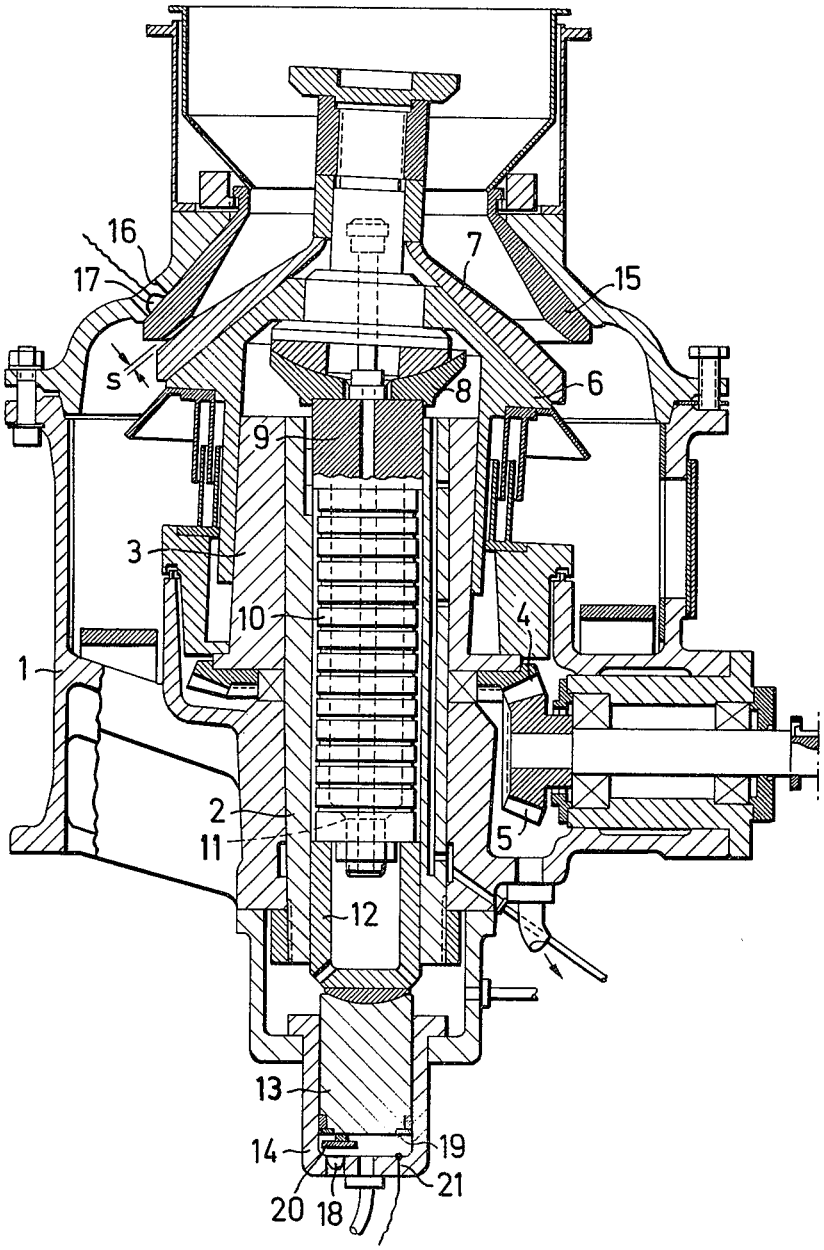
FIG. 1 is a side view showing a vertical cross section of a gyratory rock crusher with ultrasonic heads.

With the gyratory crusher of the type shown in FIG. 1, there is arranged in the housing 1 a stationary hollow shaft 2. On the outer side of the hollow shaft is positioned an eccentric bushing 3 which has on its lower end a ring gear 4, by means of which through a gear 5 the eccentric bushing is set in rotation about the hollow shaft. The crushing cone 6, which carries on its upper side a crusher cone lining 7 that is subject to wear, is positioned on the outer side of the rotatable eccentric bushing 3. The crushing cone 6 is supported in the axial direction through a concave supporting bearing 8 by a supporting shaft 9 which is slidably positioned in the inner bore of the hollow shaft 2. A spring element is contained within the supporting shaft 9, the upper end of which rests against the bottom of the supporting bearing 8. The spring element consists of a tension packet of so-called ring springs which are carried on a prolongation 11 of the supporting shaft and are tensioned under a tightening-nut on the lower end of the prolongation. Alternatively, a deformable container filled with pressure gas may be employed in place of the spring.

The lower end of the spring element 10 slidable with respect to the supporting shaft 9 is supported on a cup-shaped member 12 which is longitudinally slidable in the lower end of the bore of the hollow shaft 2.

A crusher gap width s is formed when the crusher cone lining 7 and crusher sleeve 15 are in closest approach. This gap determines the grain size of the rock crushed therebetween.

The adjustment of the gap-width s takes place through an independent piston cylinder unit 13 and 14 in separable contact with the supporting shaft 9.

In the upper part of the housing 1 is fixed the stationary crushing sleeve 15. In order to determined the gap width s between the crusher cone lining 7 and the crusher sleeve 15 taking into account the wear, there is provided a recess 16 in which is seated an ultrasonic testing head 17 directly on the outer side of the crushing sleeve. The ultrasonic head is connected to an ultrasonic measuring unit 22 which is further connected to a computer 24 and oscilloscope 25. Upon operation of the ultrasonic head, the oscilloscope display shows a starting signal blip 27 and the echo signal blip 28 reflected by the inner wall of the crushing sleeve 15. After accounting for the material constants the wall thickness of the crushing sleeve may be read off from the spacing of these two signals.

In the case of crushers which are not in operation, the use of strong signals at ultrasonic head 17 allows measurement of the actual gap width s. In addition to the echo signal 32 from the inner side of the crushing sleeve, a further echo signal 31 will be received from the adjacent outer wall of the crushing cone lining 7. By the spacing between the two echo signals represented as blips 28 and 29, the width of the crusher gap may be determined.

For continuous supervision of the crusher gap in operation, however, the ultrasonic head 17 is used solely to determine the wall thickness of the crushing sleeve 15. Reflections from the lining 7 are impossible since the cone is gyrating and rocks are falling through the gap. Hence the gap width cannot be measured. In order to determine the width of the gap, a recess is arranged in the floor of the cylinder 4 in which is located a second ultrasonic head 18. Adjacent this head a reflector surface 20 is mounted on the piston 13. This ultrasonic head 18 is likewise attached through the ultrasonic measuring unit 22 to the oscilloscope 27 and the computer 24.

Figure 2:
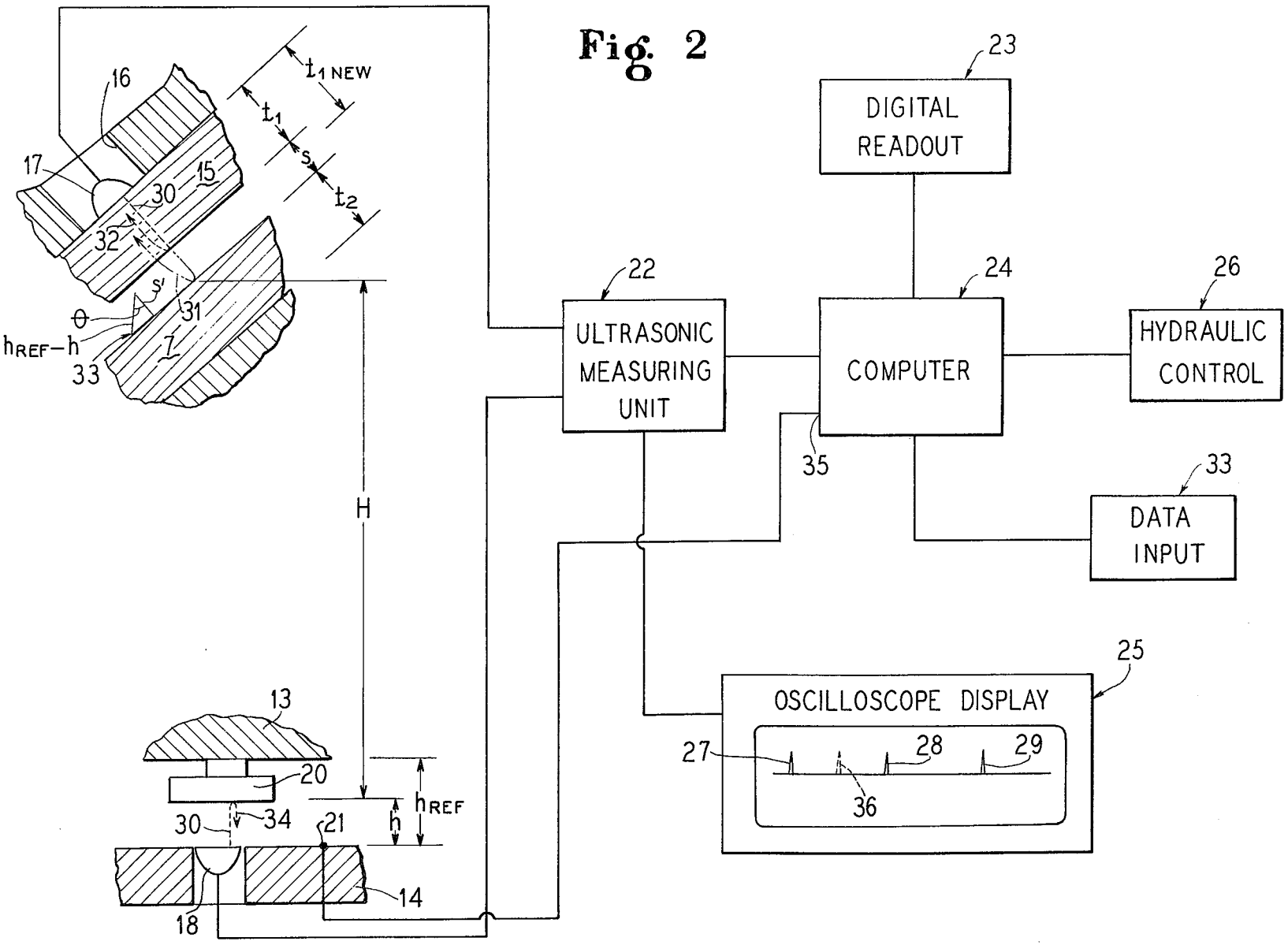
FIG. 2 is an operational block diagram of a complete ultrasonic measurement system.

The method for determining the crusher gap width s when the cone is in gyratory motion can best be understood by referring to the geometrical relationships illustrated in FIG. 2.

The reflector height $h$ is determined by ultrasonic signal 34 transmitted through the fluid in hydraulic cylinders 13 and 14. Reflector reference height hREF represents the position of the reflector surface with respect to the second head 18 when the gap width s is zero and crusher sleeve 15 and lining 7 are new, i.e. not worn. Referring to triangle 33 constructed between sleeve 15 and lining 7, the hypotenuse has a length hREF-h since the height H between the lining surface 7 and the reflector 20 is a constant. Any change of height of the reflector plate is coupled with an equal change of height at the lining 7 surface.

The angle $\theta$ of the triangle 33 is included between the hypotenuse hREF-h and a leg representing the crusher gap thickness s′ before wearing down of the sleeve 15 and corresponding thickness $t_1$NEW. This angle is known by measuring the crusher sleeve slant angle $\theta$.

From the above, s′, the gap before wearing down, can be calculated as $$s' = \frac{hREF-h}{\cos\theta} \quad (1)$$

After wearing of sleeve 15, there is a thickness change $t_1$NEW-$t_1$. Hence, the crusher gap distance can be finally expressed as $$s = s' + t_1\text{NEW}-t_1 \quad (2)$$

$$s = \frac{hREF-h}{\cos\theta} + t_1NEW-t_1 \quad (3)$$

The change in thickness of the sleeve is determined by use of ultrasonic signals 30 and 32 which measure $t_1$. $t_1$NEW is the known thickness of a new crusher sleeve 15 before any wear.

The ultrasonic measuring unit 22 supplies signals to the computer which are timed in coincidence with the transmitted signal 30 and reflected signals 34 from the reflector 20 and 32 from the inner sleeve 15 surface. The material constants for the sleeve 15 and liquid in the hydraulic cylinder 13 and 14 are stored in the computer. Using these constants, the computer 24 calculates the distances $t_1$ and $h$ respectively.

The known parameters $t_1$NEW, hREF, and $\theta$ are stored in the computer 24 and, together with the calculated values $t_1$ and $h$, the computer calculates s by formula (3) above. The crusher gap $s$ is read out to digital readout 23 together with $t_1$, the thickness of the crusher sleeve.

Since the lining 7 mounted on the crusher cone 6 also wears with time, the gap calculation based strictly upon the ultrasonic measurements will be somewhat inaccurate. Direct measurement of the lining thickness by ultrasonic means during operation is difficult since the cone gyrates and signal transfer by cable is a major problem. However, it is known from experimental data that the ratio of wear for the crusher sleeve to the crusher cone lining is 1:1 to 1:1.5. Hence, a data input 33, which is a data transmission device, is used to supply the computer with a corrected thickness $t_2$ for the lining 7. This input could be made each week, for example. If the original thickness of the new sleeve is $t_2$NEW, then the formula for calculating the crusher gap s becomes $$s = \frac{hREF - h}{\cos\theta} + t_2NEW - t_1 + t_2NEW - t_2$$

The value $t_2$ NEW is stored in the computer for comparison with read in values of $t_2$.

It is not necessary to use the experimental value approach as to the thickness of the lining 7 where so-called coarse gyratory crushers are used. In those devices the crushing cone is supported not only at its base, but also at the head-end by a cross-arm in the area of the material input. This permits placement of an ultrasonic head adjacent the inner surface of the crusher lining since the signal cable may be guided through the cross-arm. Hence direct measurement on this type of a crusher is feasible and this data may provide an on-line correction of the gap width. Other rock crusher designs besides those enumerated may also measure both crushing surfaces if means are employed to transfer ultrasonic signaLs from an interior head out to the control points.

A temperature scanner 21 is mounted in hydraulic cylinder cup member 14 on the floor of the unit directly adjacent the ultrasonic head 18. Since the scanner is in contact with the fluid, it provides signals which are proportional to the fluid temperature. Since the sound transmission constant of the fluid changes with temperature, increased accuracy in the height measurement h between the ultrasonic head 18 and reflector 20 can be obtained by an on-line correction of the computer's calculation of $h$. Hence, a temperature input 35 is provided to the computer 24.

Other, lesser important parameters affecting the measurement of the gap s may be considered in other embodiments such as pressure in the hydraulic device which can change ultrasonic transmission.

By entering the planned crusher gap width for a particular stone crushing operation into the computer by data input 33, the actual value of s computed is compared to the planned value. When differences arise, a control signal is generated to a hydraulic control 26 which either raises or lowers the height of the crusher cone 6 until the actual and planned values become equal. Hence, completely automatic control of the crusher is obtained during operation and supervision is reduced.

Although a computer 24 was used in the preferred embodiment, manual computations of the gap width may be performed, thus eliminating the need for the computer unit. The oscilloscope display may be arranged to indicate the transmitted signal 30 shown as blip 27, reflected signal 32 from the inner sleeve surface shown as blip 28, and reflected signal 34 from the reflector shown as dotted blip 36. From the time relationships of the blips, the manual operator may calculate the distance h and t, by known methods taking into consideration the hydraulic fluid temperature and transmission constants of the sleeve and fluid. Then he employs formula 4 to directly calculate s. He then compares this value to the planned crusher gap thickness, and readjusts the hydraulic cylinder height.

An obvious additional feature is the use of an alarm bell whenever either automatic or manual crusher gap changes are called for. The alarm bell may be triggered by a change in either one of ultrasonically measured distances.

In the preferred embodiment, the gap width is read out on a digital readout 23 to provide a constant indication of the thickness during operation.

Although not shown in the embodiment, in automatic operation the maximum adjusting range provided by the hydraulic cylinder may be read in using data input 33 to prevent further signaling at the hydraulic control or to trigger in alarm bell.

It will be apparent to those skilled in the art that many modifications and variations may be effected without departing from the spirit and scope of the novel concepts of the present invention.

I claim as my invention:

1. A method for the determination and adjustment of a width of a crusher gap and rate of wear of a crusher member of a gyratory crusher, particularly a gyratory crusher with hydraulic adjustment of an adjusting cone, comprising the steps of:

a. a thickness of a stationary crusher sleeve and an adjustment as to height of a crusher cone in reference to a housing are measured in each case by ultrasonic means according to an impulse-echo method and b. a width of a crusher gap is determined by means for comparison and display measuring signals generated by said ultrasonic means.

2. The method according to claim 1, wherein a signal for determination of the thickness of the crushing sleeve is displayed by said means for comparison and display.

3. The method according to claim 1, wherein the measurement of the adjustment as to height of the crushing cone by ultrasonic means comprises the measurement of a spacing of a piston bottom with respect to a cylinder floor in a hydraulic cylinder.

4. The method according to claim 3, wherein the spacing measurement takes place with reference to a reflector plate connected with the piston.

5. The method according to claim 3, wherein a temperature measurement of a hydraulic liquid in said hydraulic cylinder is used for a correction of signal recovered from the spacing measurement.

6. The method according to claim 1, wherein the comparison and display means is comprised of a computer to which the measuring signals are submitted.

7. The method according to claim 6, wherein correction data is entered in the computer to allow for a wear of a lining of the crusher cone.

8. The method according to claim 6, wherein an actual value determined in the computer for the width of the crusher gap is compared with a planned operational value to determine a deviation and the crusher cone is automatically adjusted in its height to readjust the crusher gap to the planned value when said deviations occur.

9. A method for determining a crusher gap width in a gyratory crusher having a gyrating crusher cone, a crusher sleeve surrounding said crusher cone, said crusher gap being formed therebetween at an angle to the crusher cone axis, a housing surrounding an outside of said gyratory crusher, and said crusher cone being height adjustable, wherein the method comprises:

a. measuring the crusher sleeve thickness with ultrasonics, b. measuring a change of axial height of the crusher cone with ultrasonics, and c. computing the crusher gap width using known parameters and said measurements from ultrasonics.

10. The method of claim 9, in which the planned crusher gap width is compared to the computed gap width and a hydraulic control signal is transmitted to raise or lower said crusher cone, said raising or lowering changing the gap width until it equals the planned width, and said signal being created only when there is a deviation between the planned and computed widths.

11. The method of claim 9, in which said ultrasonic measurements are displayed on an oscilloscope.

12. A method for determining a crusher gap width in a gyratory crusher having a gyrating crusher cone, a crusher sleeve surrounding said crusher cone, said crusher gap formed therebetween at an angle to the axis with said crusher cone being axially adjustable, the method comprising:

a. generating a first signal having value directly related to the crusher sleeve thickness, b. generating a second signal having value directly related to the axial position of the crusher cone, c. converting said axial position signal to a value related directly to the impovement of the cone working face relative to the sleeve, d. and comparing said signals to provide an output indicating gap thickness.

13. In a gyratory crusher having a housing, a gyrating crusher cone adjustably mounted within said housing, and a crusher sleeve attached to said housing and surrounding said crusher cone to form a crusher gap therebetween at an angle to the crusher cone axis, wherein the improvement comprises:

a. a first ultrasonic means arranged adjacent said crusher sleeve for measuring the thickness thereof;

b. a second ultrasonic means arranged adjacent said crusher cone for measuring a change of axial height thereof; and c. computing means connected to said first and second ultrasonic means for computing the crusher gap width using known gyratory crusher parameters and measurement signals from said first and second ultrasonic means.

14. The gyratory crusher of claim 13 in which the housing has in the area near the crusher gap a recess and that in said recess an ultrasonic head is seated directly on an outer surface of the crusher sleeve surrounding the crusher cone.

15. The gyratory crusher of claim 13 in which an ultrasonic head is arranged in a cylinder floor of a hydraulic adjusting cylinder below a crusher cone support member connected to said crusher cone.

16. The gyratory crusher of claim 15 in which a separate reflector surface is arranged on an adjusting piston connected to said crusher cone support member.

17. The gyratory crusher of claim 15 in which a means for measuring temperature is in thermal contact with a fluid inside of said hydraulic adjusting cylinder.

18. The gyratory crusher of claim 13 in which said computing means comprises an ultrasonic measuring unit, a computer, and display means.

19. The gyratory crusher of claim 13 in which a hydraulic control for adjusting height of said crusher cone is connected to said computing means.

* * * * *